US008164438B2

(12) United States Patent
Dougherty-Clark

(10) Patent No.: US 8,164,438 B2
(45) Date of Patent: Apr. 24, 2012

(54) SYSTEMS AND METHODS FOR PROVIDING EMERGENCY INFORMATION

(75) Inventor: Linda Dougherty-Clark, Newark, DE (US)

(73) Assignees: Linda Dougherty-Clark, Newark, DE (US); Harry J. Clark, Jr., Newark, DE (US)

( * ) Notice: Subject to any disclaimer, the term of this patent is extended or adjusted under 35 U.S.C. 154(b) by 833 days.

(21) Appl. No.: 12/188,645

(22) Filed: Aug. 8, 2008

(65) Prior Publication Data

US 2010/0033320 A1 Feb. 11, 2010

(51) Int. Cl.
*G08B 1/08* (2006.01)

(52) U.S. Cl. ..... 340/539.12; 340/436; 340/573.1; 340/903; 707/104.1

(58) Field of Classification Search ..... 340/539.12, 340/425.5, 436, 438, 573.1, 901, 903, 988, 340/539.11, 573.4; 707/104.1, 10
See application file for complete search history.

(56) References Cited

U.S. PATENT DOCUMENTS

| | | | | |
|---|---|---|---|---|
| 5,818,733 | A * | 10/1998 | Hyuga | 702/188 |
| 6,771,163 | B2 * | 8/2004 | Linnett et al. | 340/309.5 |
| 7,251,312 | B2 * | 7/2007 | D'Evelyn et al. | 379/45 |
| 2002/0026332 | A1 | 2/2002 | Snowden et al. | |
| 2002/0103622 | A1 * | 8/2002 | Burge | 702/183 |
| 2002/0111830 | A1 | 8/2002 | Tahan | |
| 2003/0040940 | A1 | 2/2003 | Nehammer | |
| 2003/0126229 | A1 * | 7/2003 | Kantor et al. | 709/217 |
| 2006/0074713 | A1 | 4/2006 | Conry et al. | |
| 2007/0038477 | A1 | 2/2007 | Kelly et al. | |
| 2007/0250348 | A1 | 10/2007 | D'Ambrosia et al. | |
| 2008/0294690 | A1 * | 11/2008 | McClellan et al. | 707/104.1 |
| 2008/0306996 | A1 * | 12/2008 | McClellan et al. | 707/104.1 |
| 2010/0256992 | A1 | 10/2010 | Roberts et al. | |

FOREIGN PATENT DOCUMENTS

WO WO 2009/077963 6/2009

* cited by examiner

*Primary Examiner* — Hung T. Nguyen
(74) *Attorney, Agent, or Firm* — Fish & Richardson P.C.

(57) ABSTRACT

In one general aspect, emergency information for a person is received from a user. A unique identifier for the person is generated. The unique identifier is associated with the emergency information. The emergency information is stored on an emergency information device. The unique identifier is associated with the emergency information device. The emergency information device is sent to the user.

8 Claims, 6 Drawing Sheets

SYSTEMS AND METHODS FOR PROVIDING EMERGENCY INFORMATION

This specification relates to providing emergency contact information for a person.

BACKGROUND

In the event of an emergency, such as a car crash, one or more of the individuals involved may be rendered incapacitated or otherwise unable to communicate with first responders (e.g., firefighters, paramedics, police officers, etc.) who arrive at the scene. This may be problematic for several reasons. Where a child is involved in the emergency and the child's caretaker is incapacitated, the first responders may be unable to determine who should be contacted to take custody of the child while the caretaker receives medical attention. Even worse, where the child suffers injuries and the caretaker is incapacitated, the first responders may be unaware of the child's allergies or preexisting medical conditions, which may result in the child having an allergic reaction, or even death.

Typical solutions to this problem include the Medic Alert® bracelet, where a person's medical information may be engraved. However, this solution is problematic because the individual may not be wearing the bracelet at the time of the accident. Children in particular may be unwilling to wear the bracelet, or may lose or misplace it. In addition, the amount of space available on a Medic Alert® bracelet may be limited, preventing contact information from being provided or the expression of all of a childs medical needs or requirements. Moreover, in an emergency situation, it may be difficult for the first responder to read the bracelet, or take the time to stop and read the information.

SUMMARY

In one general aspect, emergency information for a person is received from a user. A unique identifier for the person is generated. The unique identifier is associated with the emergency information. The emergency information is stored on an emergency information device. The unique identifier is associated with the emergency information device. The emergency information device is sent to the user.

Implementations may include one or more of the following features. The emergency information may be received through the internet. The emergency information may be received through the telephone network. Storing the emergency information on an emergency information device may include generating speech data from the emergency information, and storing the generated speech data on the emergency information device. The speech data may be generated from the emergency information by a computer using text-to-speech processing. The speech data may be generated by a human reading the emergency information into a recording device. The emergency information may include medical information. The emergency information may include contact information.

In another general aspect, an emergency information device is adapted to receive emergency information, store the received emergency information, receive a request to provide the emergency information, and provide the emergency information in response to the request.

Implementations may include the following features. The emergency information device may be adapted to receive a digital voice recording of the emergency information. The digital voice recording of the emergency information may be provided by a computer and generated by the computer using text to speech techniques using a text version of the emergency information. The emergency information device may be adapted to play the digital voice recording of the emergency information through a speaker. The emergency information device may be adapted to be received in a holder device. The holder device is integrated into a vehicle. The holder device may be integrated into a car seat.

The details of one or more implementations of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

I. Overview

Figure 1B:
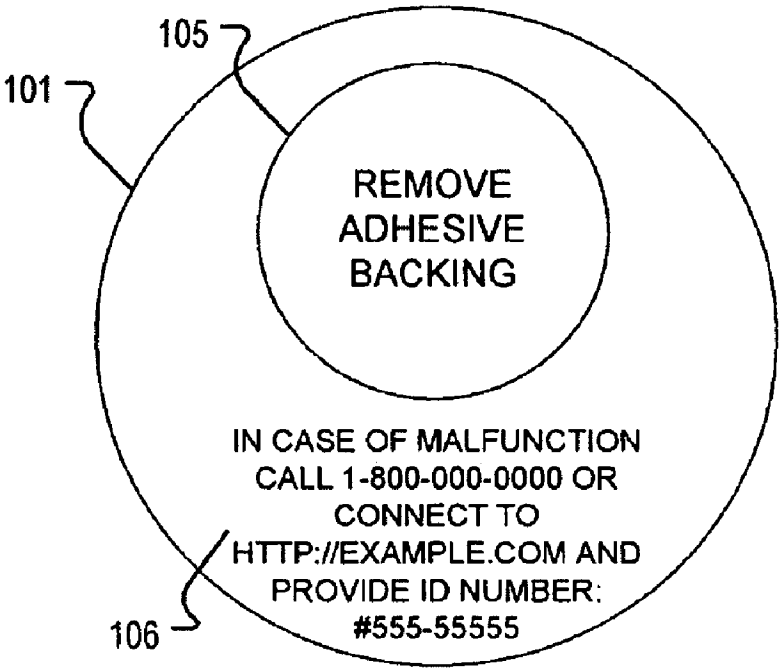
FIGS. 1*a-c* are illustrations of an example emergency information device 100.
Figure 1A:
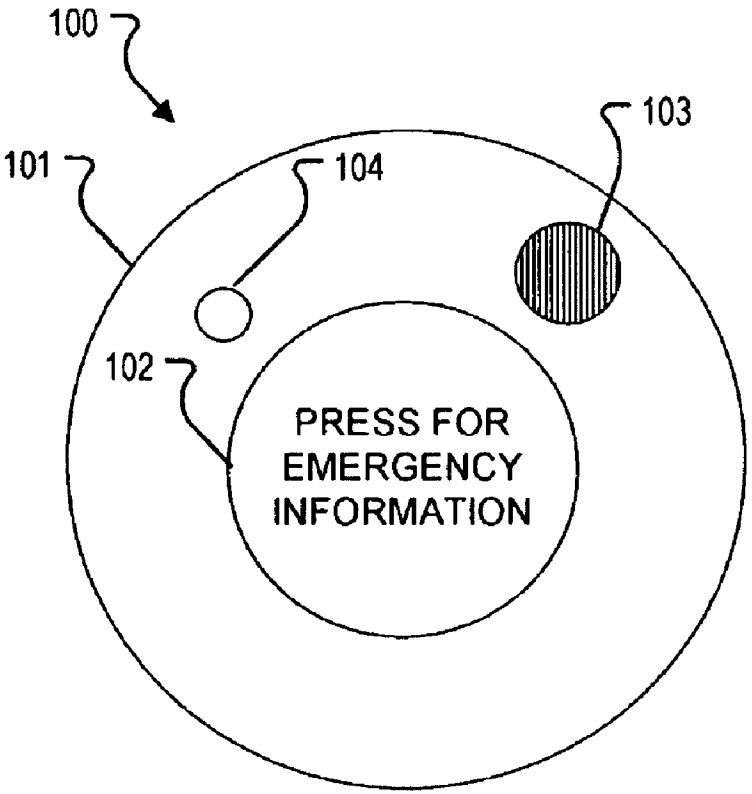

FIG. 1*a* is an illustration of an example emergency information device 100. The emergency information device 100 is adapted to store a digital voice recording of an individual's emergency information to be used when the individual, or the individual's caretaker, is otherwise incapacitated. First responders (e.g., police, firefighters, paramedics, etc.) who come across an individual who is incapacitated or otherwise unable to provide emergency information, may use the device to hear a digital recording that includes the individual's emergency information. In some implementations, the emergency information may include primary and secondary contact information (e.g., the name, phone number, and address of a person to contact in case of an emergency involving the individual). The emergency information may further include medical information about the individual such as blood type (e.g., A, B, O, etc.), food allergies (e.g., shellfish, peanuts, etc.), medicine allergies (e.g., penicillin), and medical conditions (e.g., asthma, diabetes, etc.).

In some implementations, the emergency information device 100 may be adapted to fit in a specialized holder. The holder may be integrated into the dashboard of a vehicle associated with the individual. The first responders may then be trained to locate the holder in the event of an emergency and retrieve the emergency information device from the vehicle. In other implementations, the holder may be integrated into a car seat associated with a child. In the event of an emergency, the emergency information device may be retrieved from the car seat by the first responders. In some implementations, a decal or decal may be attached to the exterior of the vehicle (e.g., the windshield, or bumper). The decal may indicate to the first responders that an emergency information device 100 is associated with one or more of the passengers of the vehicle.

In some implementations, the emergency information may be recorded onto the emergency information device 100 by a retailer or manufacturer associated with the emergency information device. A customer, through the telephone, mail, or Internet, may provide desired emergency information (e.g., contact information and medical information) to the manufacturer. The manufacturer may receive the emergency information and record the emergency information onto the emergency information device. The emergency information recording may be made automatically by a computer, or by a voice professional, to ensure that that the recorded voice information will be clear and audible to a first responder in an emergency situation. The emergency information device with the recorded emergency information may then be provided to the requesting customer and placed in the holder.

II. Description of Emergency Information Device

FIG. 1*a* is an illustration of the front of the emergency information device 100. As illustrated, the emergency information device 100 has a casing 101. The casing 101 may comprise a plastic or metal casing designed to hold and protect the components of the emergency information device. The casing 101 may be designed to be durable and survive a car accident, fire, or other emergency. The casing 101 may be fire and water resistant. Example materials include high quality plastic, and metal. However, a variety of other materials may be used.

The casing 101 may be a variety of sizes and shapes. In one implementation, the casing 101 may be three inches in diameter and approximately one centimeter in thickness. However, a variety of other dimensions may be used. The size of the casing 101 may be chosen to provide high visibility to first responders, while not being so cumbersome as to inconvenience the user or wearer. Although illustrated as a circle, the casing 101 may constructed in a variety of shapes. For example, the casing 101 may be sized to approximate a business card or drivers license.

The casing 101 may be colored to provide high visibility to first responders. In some implementations, the casing 101 may be painted using florescent paints and colors to provide optimal visibility. The casing 101 may also include reflective or glow-in-the-dark elements to further increase the visibility of emergency information device to first responders.

The emergency information device 100 may further include an emergency information button 102. The button 102, when pressed or activated, may cause the emergency information device 100 to play the stored emergency information. In some implementations, the button 102 is approximately one inch in diameter and located in the center of the casing 101, however a variety of button sizes and placement arrangements may be used. Implementations of the button 102 are not limited to buttons. A variety of controlling, switching or actuation means may used for the button 102.

The emergency information device 100 may further include a speaker 103. The speaker 103 may provide audio output for the emergency information device 100. For example, when the button 102 is pressed, the recorded emergency information may be played through the speaker 103 to a first responder. The speaker 103 may be implemented using a variety of small, efficient, and durable miniature speakers currently available. While illustrated in the top-right position of the casing 101, the speaker 103 may be placed in a variety of positions in the casing 101.

In some implementations, the speaker 103 is also a microphone capable of receiving spoken versions of the emergency information from the users. In some implementations, where the users are not permitted to record their own emergency information (e.g., to prevent tampering or inaudible recordings) the microphone functionality of the speaker 103 may be disabled or otherwise made inoperable.

The emergency information device 100 may also include an indicator light 104. The indicator light 104 may provide an indication that the emergency information device 100 is operating correctly (e.g., has battery power). In some implementations, the light 104 may be a low-power LED light that glows green or some other color to indicate that the device 100 is functional. However, a variety of bulb types and colors may be used. In addition, the light 104 may serve the additional purpose of helping first responders locate the casing 101. While illustrated in the top-right portion of the device 100, the light 104 may be placed in a variety of positions and places in the casing 101.

FIG. 1*b* is an illustration of the back of the emergency information device 100. The emergency information device 100 may include an adhesive means 105. The adhesive means 105 may allow the emergency information device 100 to be placed on the associated individual during the emergency. For example, if a child is in a car accident, the first responder may remove the child and the emergency information device 100 from the car. The first responder may then remove a backing from the adhesive means 105 and adhere the emergency information device 100 to the child using the adhesive means 105. Adhering the emergency information device 100 to the child may ensure that the emergency information device 100 does not become lost or disassociated from the child during an emergency.

The adhesive means 105 may be implemented using a variety of well known methods and techniques for attaching. For example, the adhesive means 105 may be implemented using a high quality glue, tape, or other adhesive. Pins may also be used for the adhesive means 105. While illustrated in the top portion of the casing 101 the adhesive means 105 may be placed in a variety of positions and locations on the casing 101.

The emergency information device 100 may also include malfunction information 106. In the event that the emergency information device breaks or malfunctions, the malfunction information 106 provides a telephone number and URL, where the first responders may retrieve the recorded emergency information by providing a unique identifier associated with each emergency information device 100. While illustrated in the top portion of the casing 101 the malfunction information 106 may be placed in a variety of positions and locations on the casing 101.

Figure 1C:
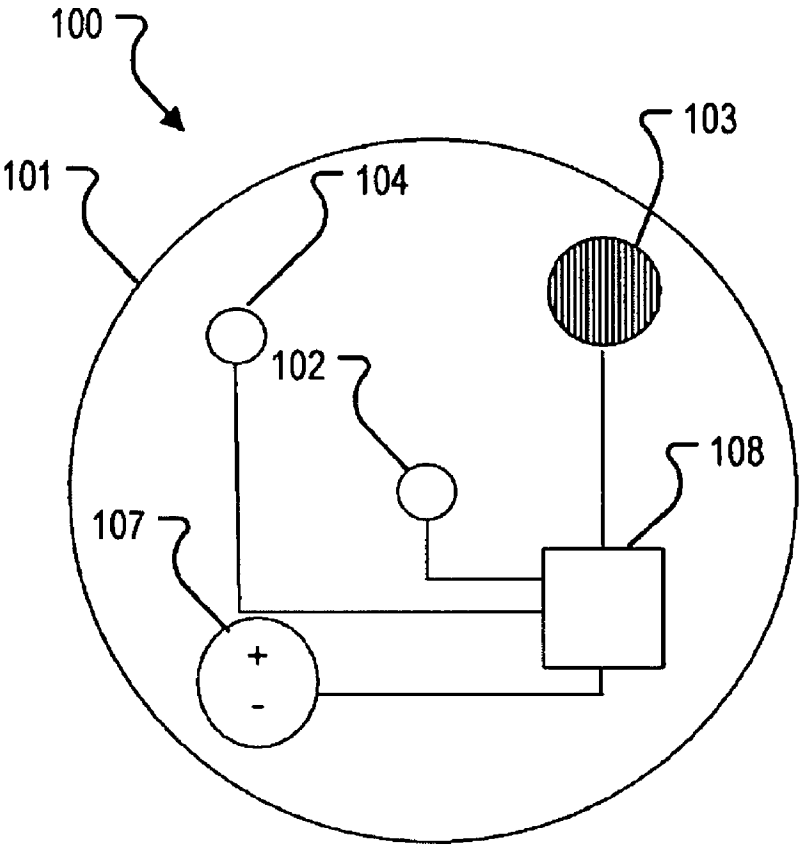

FIG. 1*c* is an illustration of the internal components of the emergency information device 100. The emergency information device 100 may include a battery 107. The battery 107 may be one of a variety of batteries known in the art. The battery 107 may chosen for maximum battery life, while at the same time being of a sufficiently small size to fit in the casing 101. In some implementations, watch batteries may be used.

The emergency information device 100 may further include a processor and memory component 108. The processor and memory component 108 may receive and store the recorded emergency information. In some implementations, the processor and memory component 108 may receive the emergency information audibly though the speaker 103 (e.g., a professional speaker may read the emergency information into the speaker 103). In other implementations, the processor and memory component 108 may receive the emergency information digitally through a port or other connection (not shown).

In some implementations, the memory of the processor and memory component 108 may comprise EEPROM or flash memory. However, other memory types may also be used. The size of the memory used is dependent on the length of the emergency information (i.e., how long it takes to speak) and the sampling-rate chosen for the recording (i.e., the quality of the recording). In some implementations the processor and memory component 108 may be implemented by a chip such as the ISD5100 series of chips available from ChipCorder®. However, other chips, processors, and microcontrollers may also be used.

The processor and memory component 108 may receive activation signals from the button 102, and as a result may cause the recorded emergency information to play through the speaker 103. The processor and memory component 108 may receive power from the battery 107 and control the display of the light 104. Alternatively, the light 104 may be directly connected to the battery 107.

III. Emergency Device Holder and Decal

Figure 2C:
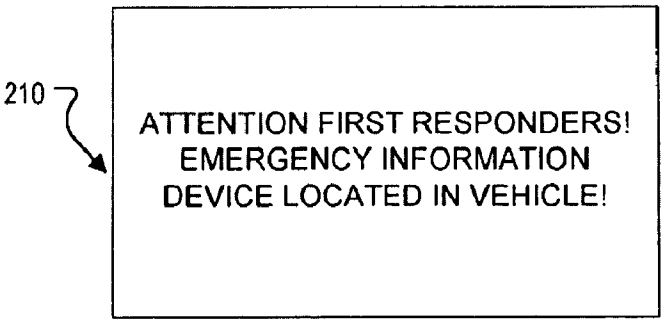
FIG. 2*c* is a diagram of an example decal for use with an emergency information device 100.
Figure 2B:
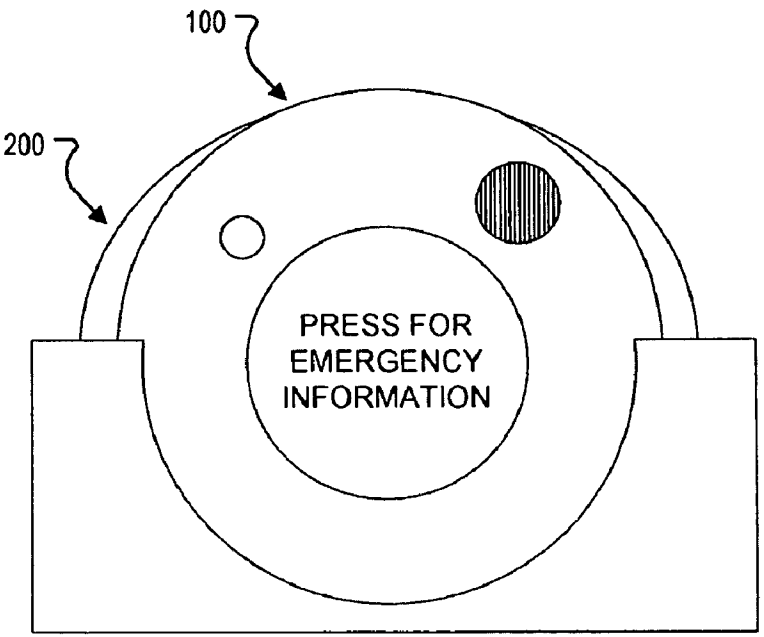
FIGS. 2*a-b* are illustrations of an example emergency information device holder 200.
Figure 2A:
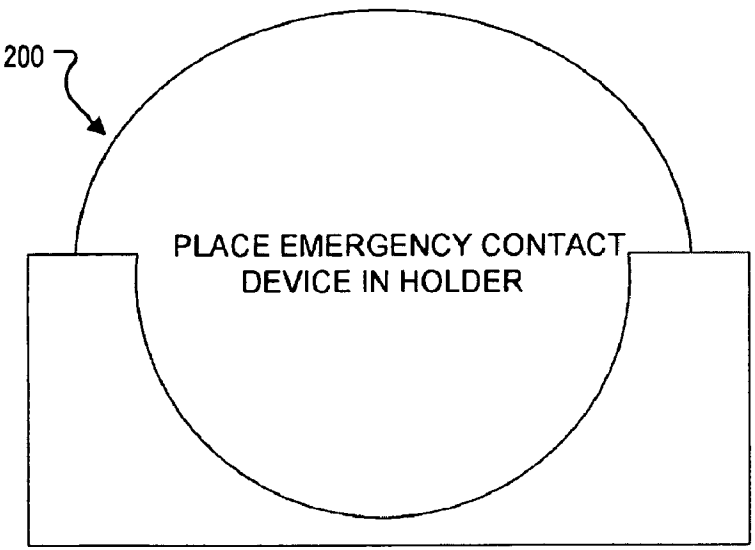

FIG. 2*a* is an illustration of the emergency information device holder 200. The emergency device holder 200 is designed to receive and hold the emergency information device 100. Accordingly, the emergency device holder 200 includes a receptacle that is sized slightly larger than the casing 101, so that it may receive the emergency information device 100 easily, hold it securely, but also allow first responders to easily locate and remove the emergency information device 100. Similarly to the emergency information device 100, the emergency information device holder 200 may be designed and colored to be easily located by first responders. FIG. 2*b* illustrates the emergency information device 100 placed in the holder 200.

In some implementations, the emergency information device holder 200 is integrated into a variety of vehicles, safety devices, and other objects. The emergency information device holder 200 may be integrated into car seats, strollers, bicycles, tricycles, big-wheels, life-jackets, the interiors of cars, boat and airplanes, helmets, wheelchairs, etc. For example, the device holder 200 may be integrated into a military vehicle, helmet, or other piece of military gear or equipment. The corresponding device 100 may contain the emergency information of a soldier associated with the vehicle, helmet, or other piece of military gear or equipment.

In some implementations, the manufacturer of a device or vehicle may receive the specification of the emergency information device holder 200 from the manufacturer of the emergency information device 100 and integrate the holder 200 directly into the device or vehicle. For example, a maker of a car seat may manufacture a car seat with an integrated holder 200. The car seat manufacturer may then advertise the car seat as being compatible with the emergency information device 100.

In other implementations, the holder 200 may be added to the vehicle or device after the vehicle or device is manufactured as an aftermarket product. For example, the holder 200 may include a fastener (not shown) that may tie, or otherwise connect, to various car seat models. Similarly, a holder 200 may include an adhesive means to allow it to adhere to a portion of a car dashboard, for example.

FIG. 2*c* is an illustration of an example decal 210 to be used with the emergency information device 100. The decal 210 may be colored and designed to draw the attention of a first responder in the event of an accident. The decal 210 may be placed in the windshield of a car, or other vehicle, to alert first responders that an emergency information device 100 is associated with one of the passengers of the vehicle.

For example, a car seat in a car may include an integrated holder 200 with an emergency information device 100. The owner of the vehicle may place the decal 210 in the window of the vehicle to alert first responders that an emergency information device 100 is in the vehicle. The first responders may have been trained, or otherwise instructed, to look for the decal 210 in the event of an emergency.

IV. Interface and Method for Providing Emergency Information

Figure 3:
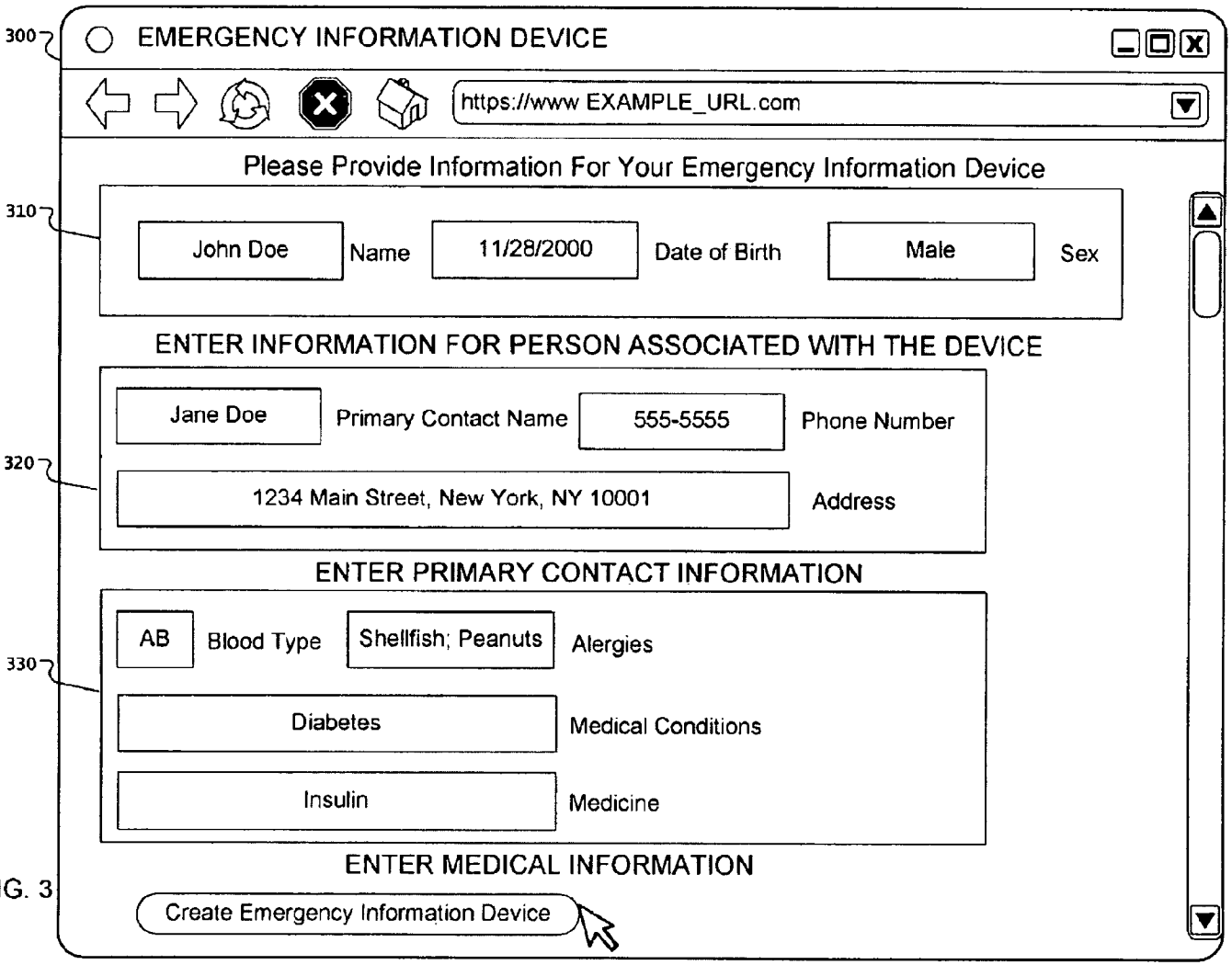
FIG. 3 is an illustration of a user interface 300 for providing emergency information for an emergency information device 100.
Figure 5:
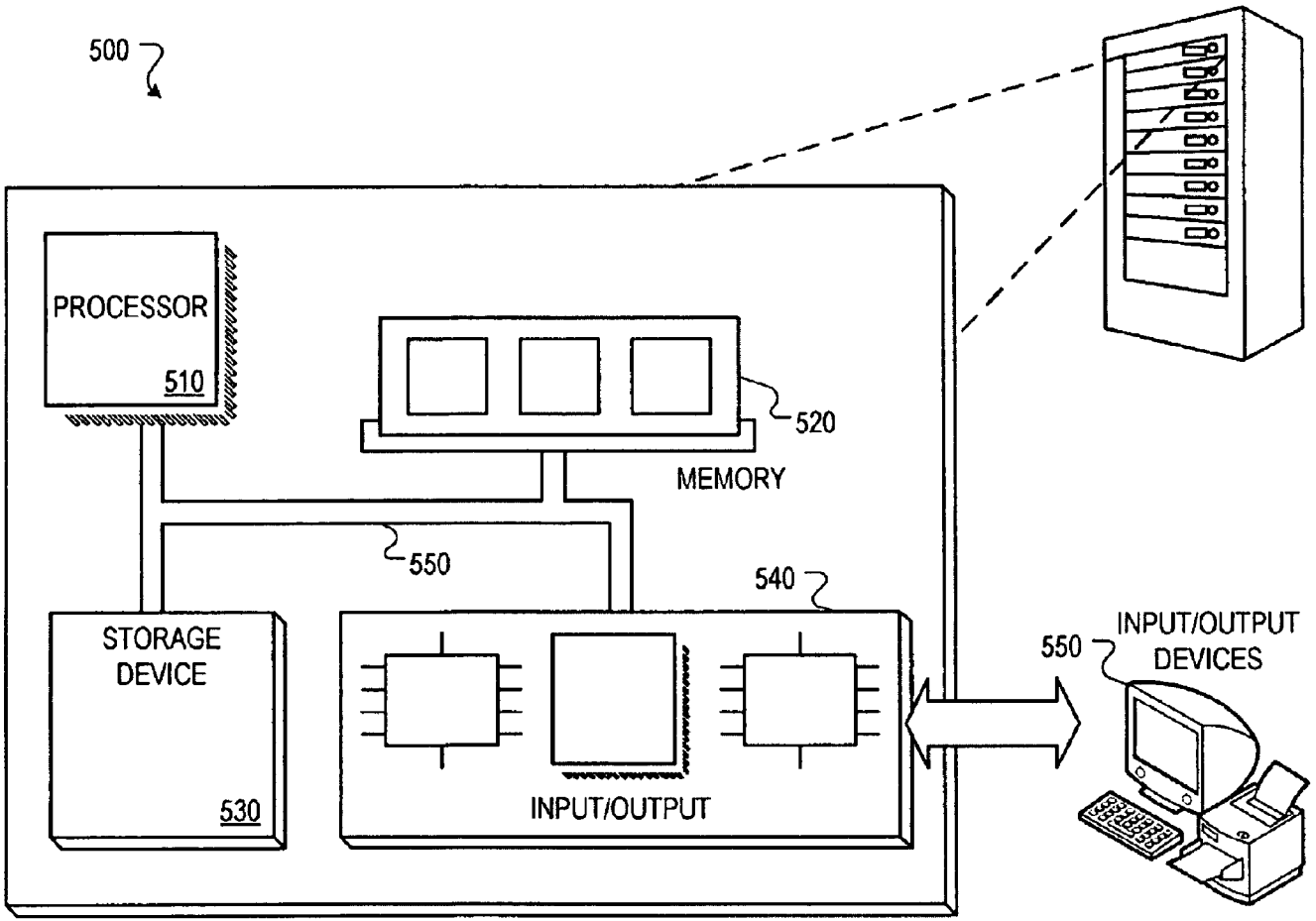
FIG. 5 is an illustration of an example computing environment 500 that can be utilized to implement the systems and methods described herein.

FIG. 3 is an example user interface 300 for providing emergency information. A customer wishing to purchase an emergency information device 100 may connect to a server associated with the manufacturer of the emergency information device 100 though the Internet using a browser. An example server is illustrated in FIG. 5. For example, as illustrated in FIG. 3, a customer has connected to the URL "https://www.example_URL.com".

Upon connection to the server, the customer may be presented with the user interface 300 though the browser. The user interface 300 may allow the customer to provide emergency content information for themselves, a child, or other person, to be recorded onto a emergency information device 100. Alternatively, the customer may provide the information to an operator through a telephone, or may write the emergency information onto a form and mail the emergency information to the manufacturer.

The user interface 300 may include a person identification window 310. The person identification window 310 may receive the name, date of birth, and the sex of the person whose information will be recorded onto the emergency information device 100.

The user interface 300 may include an emergency contact information window 320. The emergency contact information window 320 may receive the name, address, and phone number of the emergency contact for the person whose information is recorded onto the device. While only one emergency contact information window 320 is shown, the user interface 300 may include several windows 320 allowing for several emergency contacts to be listed.

The user interface 300 may include a medical information window 330. The medical information window 330 may receive medical information for the person whose information is recorded onto the device. The medical information may include blood type, allergies, medication and existing medical conditions, for example.

After the customer has completed the user interface 300, they may submit the information by selecting the "Create Emergency Information Device" button. Upon selection, the emergency information is transmitted to the server associated with the manufacturer of the device 100, and recorded onto the processor and memory component 108 of the device 100, for example. In some implementations, the emergency information is automatically converted into spoken form by a computer. Any method of converting text to speech may be used. In other implementations, the emergency content information is read aloud and recorded by a professional speaker or voice actor, or by someone possessing a suitably clear and precise voice. The spoken emergency information may then be stored in the processor and memory component 108.

An example spoken transcript for the emergency information entered into FIG. 3 is illustrated below:

FIRST NAME, JOHN, J O H N

LAST NAME, DOE, D O E.

DATE OF BIRTH, ELEVEN DASH TWENTY-EIGHT DASH TWO-THOUSAND.

ALLERGIES, SHELLFISH, PEANUTS.

MEDICAL CONDITIONS, DIABETES.

MEDICINE, INSULIN

BLOOD TYPE: AB.

PRIMARY CONTACT NAME, JANE DOE

PRIMARY CONTACT PHONE, FIVE FIVE FIVE DASH FIVE FIVE FIVE FIVE

Figure 4:
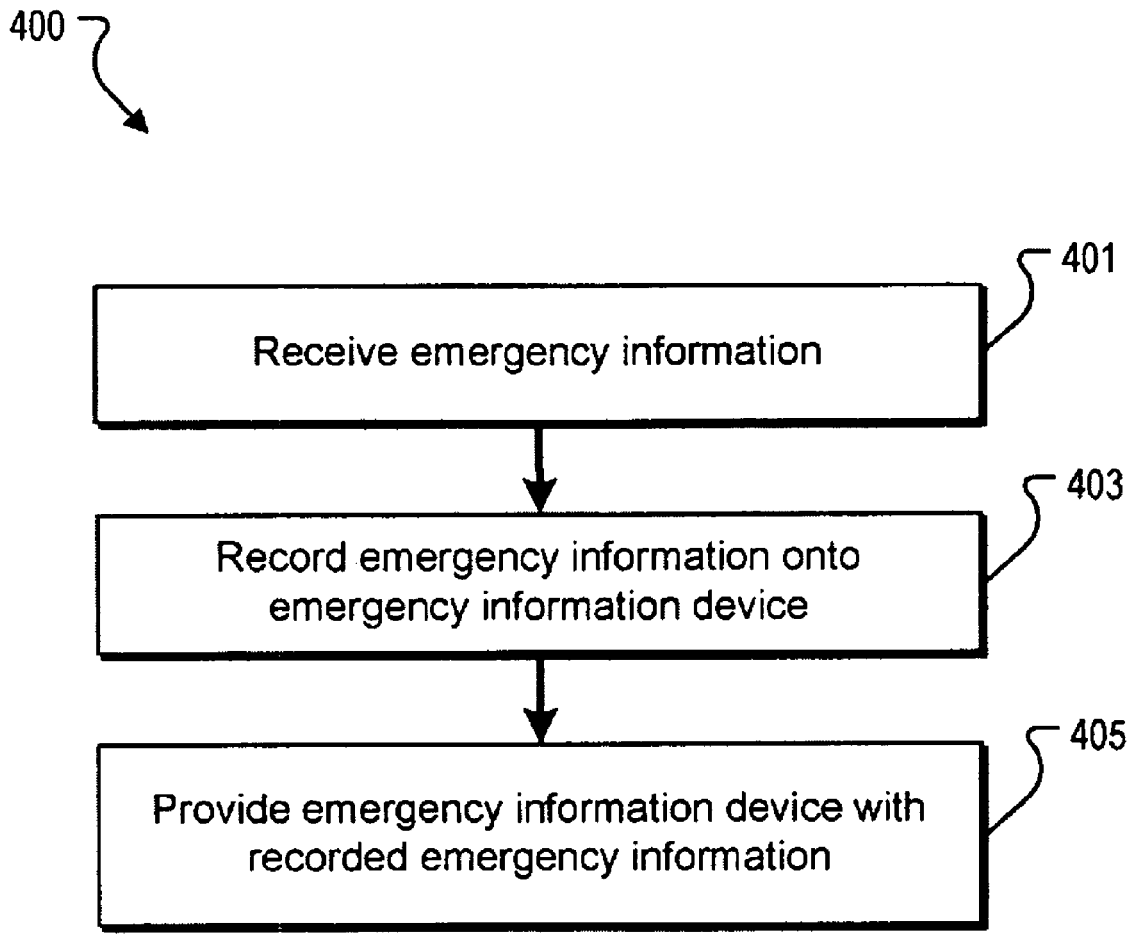
FIG. 4 is a flow diagram of an example process for providing emergency information for an emergency information device 100.

FIG. 4 is an illustration of an example process 400 for providing and storing emergency information on an emergency information device 100.

Emergency information is received (401). In some implementations, the emergency information may received by a manufacturer of the emergency information device 100. In some implementations, the information is received through the Internet through the user interface 300 implemented at a server associated with the manufacturer. In other implementations, the information is received through the telephone or through a form provided in a magazine or newspaper advertisement, for example.

Emergency information is recorded onto an emergency information device (403). In some implementations, the emergency information is converted into speech by a computer and stored onto the processor and memory component 108 of the emergency information device 100. In other implementations, a human may speak the emergency contact information into a recorder, and a copy of the recording may be stored on the processor and memory component 108.

In addition, a unique identification number may be assigned to the emergency information device. The unique identification number may also be written or engraved onto the emergency contact device as part of the malfunction information 106. The unique identification number may allow a first responder to retrieve the emergency information through the internet or the telephone in the even of a failure or malfunction of the emergency information device.

The emergency information device is provided to the person who provided the emergency information (405). For example, the emergency information device may be mailed to the person who provided the emergency information. The emergency information device 100 may then be placed in a holder 200 associated with the person whose emergency information was provided.

V. Example Computing Environment

FIG. 5 is a block diagram of an example computer system 500 that can be utilized to implement the systems and methods described herein. The system 500 includes a processor 510, a memory 520, a storage device 530, and an input/output device 540. Each of the components 510, 520, 530, and 540 can, for example, be interconnected using a system bus 550. The processor 510 is capable of processing instructions for execution within the system 500. In one implementation, the processor 510 is a single-threaded processor. In another implementation, the processor 510 is a multi-threaded processor. The processor 510 is capable of processing instructions stored in the memory 520 or on the storage device 530.

The memory 520 stores information within the system 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the system 500. In one implementation, the storage device 530 is a computer-readable medium. In various different implementations, the storage device 530 can, for example, include a hard disk device, an optical disk device, or some other large capacity storage device.

The input/output device 540 provides input/output operations for the system 500. In one implementation, the input/output device 540 can include one or more network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 560.

The apparatus, methods, flow diagrams, and structure block diagrams described in this patent document can be implemented in computer processing systems including program code comprising program instructions that are executable by the computer processing system. Other implementations can also be used. Additionally, the flow diagrams and structure block diagrams described in this patent document, which describe particular methods and/or corresponding acts in support of steps and corresponding functions in support of disclosed structural means, can also be utilized to implement corresponding software structures and algorithms, and equivalents thereof.

This written description sets forth the best mode of the invention and provides examples to describe the invention and to enable a person of ordinary skill in the art to make and use the invention. This written description does not limit the invention to the precise terms set forth. Thus, while the invention has been described in detail with reference to the examples set forth above, those of ordinary skill in the art can effect alterations, modifications and variations to the examples without departing from the scope of the invention.

What is claimed is:

1. A computer-implemented method using a processor, the method comprising:

receiving emergency information for a person from a user at a remote location;

generating a unique identifier for the person;

associating the unique identifier with the emergency information;

storing the emergency information on an emergency information device;

associating the unique identifier with the emergency information device; and sending the emergency information device with the stored emergency information processed by the processor to the user.

2. The method of claim 1, wherein the emergency information is received through the internet.

3. The method of claim 1, wherein the emergency information is received through the telephone network.

4. The method of claim 1, wherein storing the emergency information on an emergency information device comprises:

generating speech data from the emergency information; and storing the generated speech data on the emergency information device.

5. The method of claim 4, wherein the speech data is generated from the emergency information by a computer using text-to-speech processing.

6. The method of claim 4, wherein the speech data is generated by a human reading the emergency information into a recording device.

7. The method of claim 1, wherein the emergency information includes medical information.

8. The method of claim 1, wherein the emergency information includes contact information.

* * * * *